US011213717B2

(12) United States Patent
Pfaff

(10) Patent No.: US 11,213,717 B2
(45) Date of Patent: Jan. 4, 2022

(54) POWER ROWING MACHINE WITH PIVOTING WEIGHT ARM

(71) Applicant: Thomas J. Pfaff, Ithaca, NY (US)

(72) Inventor: Thomas J. Pfaff, Ithaca, NY (US)

( * ) Notice: Subject to any disclaimer, the term of this patent is extended or adjusted under 35 U.S.C. 154(b) by 21 days.

(21) Appl. No.: 16/783,212

(22) Filed: Feb. 6, 2020

(65) Prior Publication Data

US 2020/0269085 A1 Aug. 27, 2020

Related U.S. Application Data

(60) Provisional application No. 62/809,049, filed on Feb. 22, 2019.

(51) Int. Cl.

| | |
|---|---|
| ***A63B 22/00*** | (2006.01) |
| ***A63B 21/00*** | (2006.01) |
| ***A63B 22/20*** | (2006.01) |
| ***A63B 21/06*** | (2006.01) |

(52) U.S. Cl.

CPC ..... *A63B 22/0076* (2013.01); *A63B 21/0615* (2013.01); *A63B 21/154* (2013.01); *A63B 21/4034* (2015.10); *A63B 21/4035* (2015.10); *A63B 22/203* (2013.01); *A63B 2022/0079* (2013.01)

(58) Field of Classification Search

CPC .. A63B 22/0076–0089; A63B 21/0615; A63B 21/154; A63B 21/159

See application file for complete search history.

(56) References Cited

U.S. PATENT DOCUMENTS

| | | | | |
|---|---|---|---|---|
| 3,558,130 | A * | 1/1971 | Anderson | A63B 21/4043 482/72 |
| 3,708,167 | A * | 1/1973 | Potgieter | A63B 21/0615 482/100 |
| 4,211,403 | A * | 7/1980 | Coffaro | A63B 17/00 482/104 |
| 4,226,414 | A * | 10/1980 | Coffaro | A63B 21/0615 482/97 |
| 5,358,462 | A * | 10/1994 | Calderone | A63B 21/0615 482/102 |
| 2005/0148445 | A1* | 7/2005 | Carle | A63B 21/4035 482/97 |
| 2011/0190104 | A1* | 8/2011 | Derrick | A63B 26/00 482/142 |
| 2012/0094804 | A1 | 4/2012 | Bell et al. | |
| 2020/0215389 | A1* | 7/2020 | Huang | A63B 21/0615 |

* cited by examiner

*Primary Examiner* — Joshua Lee
*Assistant Examiner* — Catrina A Letterman
(74) *Attorney, Agent, or Firm* — Bond Schoeneck and King PLLC; David Nocilly; Lacey Miller

(57) ABSTRACT

A power rowing machine that combines the seat of a rowing machine with a weight arm for resistance training. The power rowing machine avoids the flywheel of a conventional rowing machine and instead uses a weight arm. The weight arm serves two purposes. First, weight can be added to the arm for progressive resistance training. Second, the pivoting action varies the resistance through the movement. As a slow controlled resistance exercise the back and the arms of the rowing stroke cannot move the same resistance as the legs. Similarly, a user at the beginning of the rowing motion, with the legs compressed, cannot move as much resistance as with knees at a 90-degree angle.

12 Claims, 5 Drawing Sheets

POWER ROWING MACHINE WITH PIVOTING WEIGHT ARM

CROSS-REFERENCE TO RELATED APPLICATIONS

The present application claims priority to U.S. Provisional No. 62/809,049, filed on Feb. 22, 2019.

BACKGROUND OF THE INVENTION

1. Field of the Invention

The present invention relates to exercise equipment and, more specifically, to rowing machines.

2. Description of the Related Art

A rowing machine is primarily an aerobic fitness machine used to simulate on the water rowing. A seated cable row is a strength training machine aimed primarily to strengthen back muscles. The seated cable row does not have a sliding seat like a rowing machine and the resistance is uniform as the cable is moved horizontally. Other approaches, such as that seen in US 20120094804, have a sliding seat and a pulley weight system to return the weight to resting. However, an automatic return without the aid of the user does not have an eccentric contraction phase for the muscles involved (contraction as the muscle lengthens often referred to as the negative of a weight exercise). As a result, this type of equipment is designed more for plyometric type of exercise as opposed to a strength exercise. Further, as the weight resistance uses a pulley system to vertically move a weight stack, the resistance throughout the motion is the same, which is not ideal for a resistance exercise through the full range of the rowing motion as the arms cannot move as much weight at the legs.

SUMMARY

The present invention is a strength training machine designed as a power rowing machine to simultaneously strengthen the leg, back, and arm muscles of the rowing motion, while incorporating core muscles in a fashion used by rowers. The power rowing machine has advantages over traditional leg strengthening exercise such as the squat, deadlift, and leg press. The range of motion of the power rowing machine is greater than that for a squat or deadlift and uses the glutes and core muscles differently. The range of motion of the power rowing machine is similar to that of a leg press, but the leg press does not require core support. The power rowing machine also incorporates the lower back and arm muscles as in the rowing stroke.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION

Figure 1:
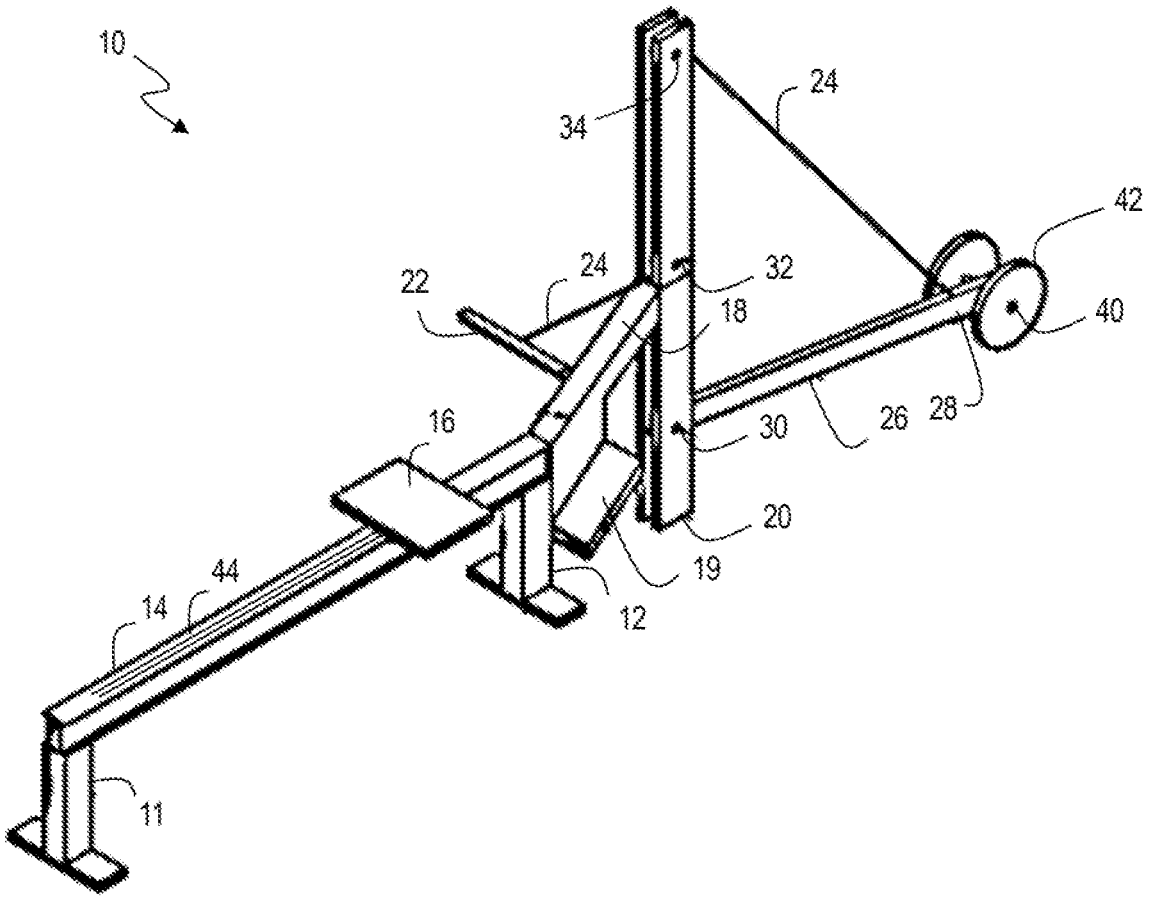
FIG. 1 is a perspective view of a power rowing machine in a released position.
Figure 2:
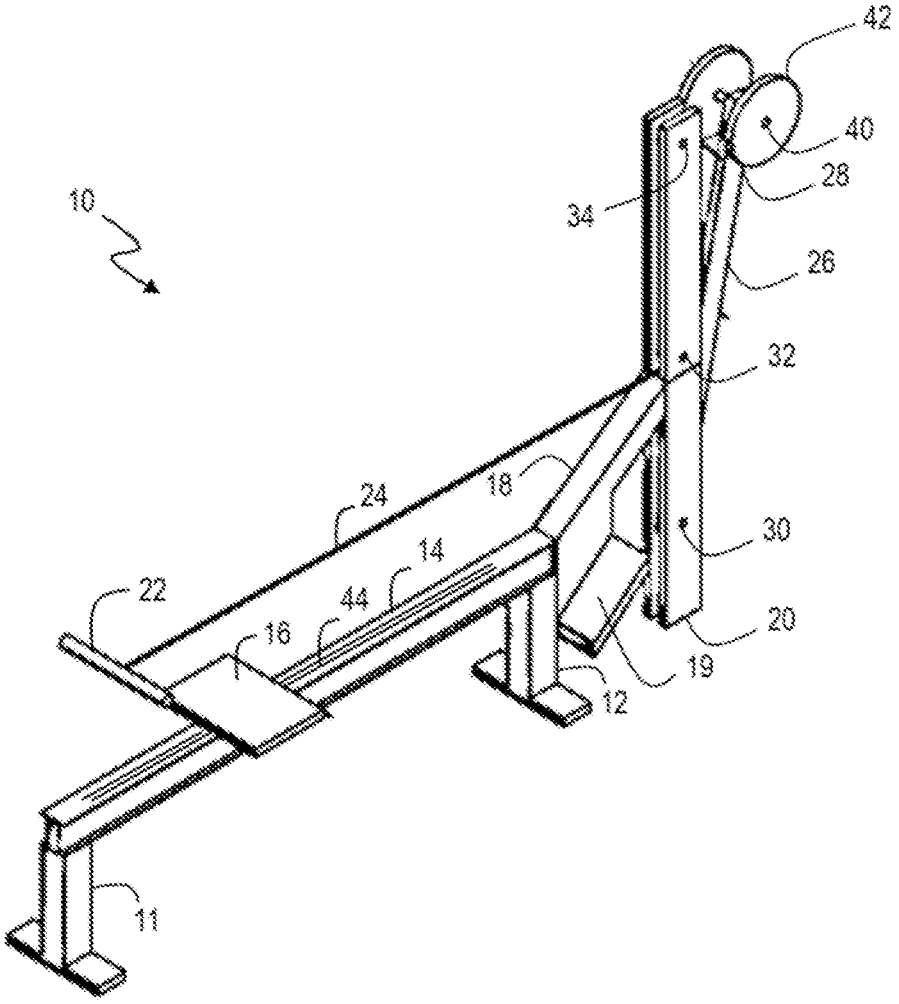
FIG. 2 is a perspective view of a power rowing machine in a pulled position.

Referring to the figures, wherein like numerals refer to like parts throughout, there is seen in FIG. 1 and FIG. 2 a power rowing machine 10 according to one embodiment. The power rowing machine 10 comprises a pair of legs 11 and 12, a seat beam 14, a seat 16, a support beam 18, a support column 20, a pull bar 22, a cable 24, a weight arm 26, weight posts 40, and weights 42. Legs 11 and 12 connect to and support two ends of the seat beam 14 separately.

Figure 3:
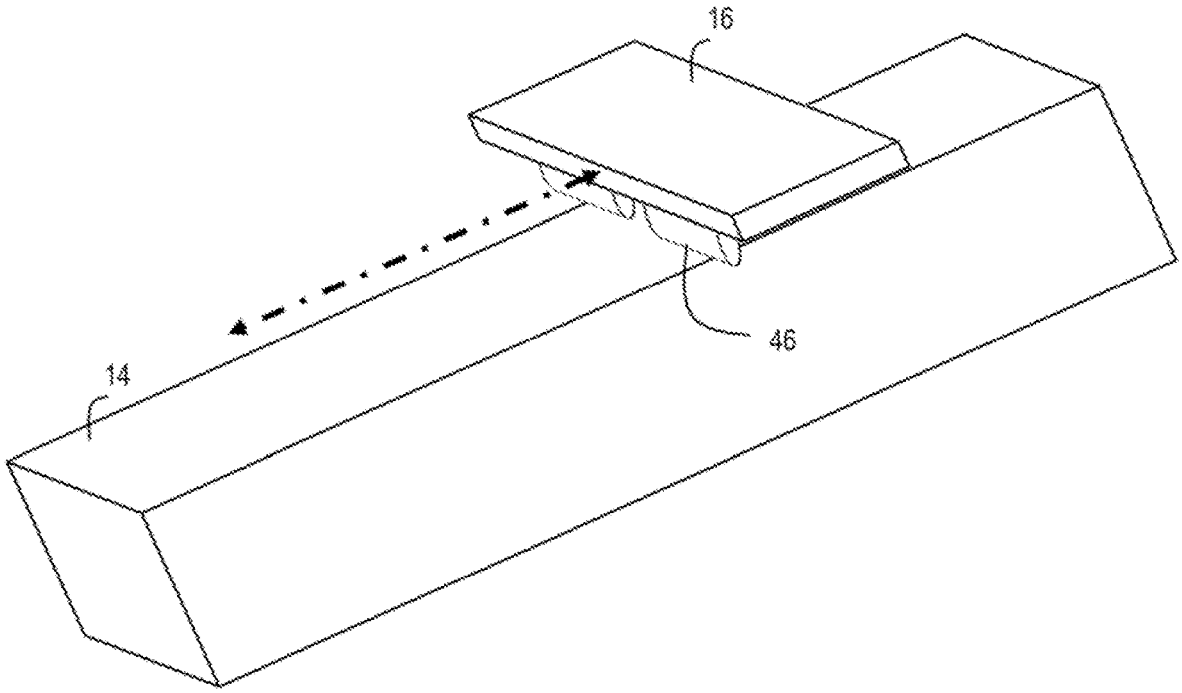
FIG. 3 is a perspective view of a seat having rollers for moving along a seat beam according to the present invention.

In one embodiment, seat beam 14 has track 44 along it. Track 44 runs along the longitudinal axis of the seat beam 14. Track 44 can also be accomplished by two tracks running along seat beam 14. Seat 16 can slide along track 44 while a user is using the power rowing machine 10. Seat 16 movement can also be accomplished by other means such as, but not limited, to rolling using rollers 46 as seen in FIG. 3. Seat 16 can be any shape or material that is suitable for a user to be seated on.

Support beam 18 connects between one end of the seat beam 14 and support column 20. Support beam 18 can have two pedals 19 connected on opposite sides of support beam 18. Pedals 19 are configured for a user to put his/her feet on to the pedals 19 while the user is sitting on the seat 16 and pushing against the pedals 19 with his/her feet. Pedals 19 can be inclined toward seat beam 14. Pedals 19 can also comprise straps or other securing devices.

Support column 20 is connected to weight arm 26 via a pivotal connection 30 located in the lower portion of the support column 20. Support column 20 further includes a first fixed pulley 32 positioned in an intermediate portion and interiorly thereof and a second fixed pulley 34 in the upper portion of support column 20. Fixed pullies 32 and 34 are located above the seat beam 14 on the latitudinal axis. The first fixed pulley 32 can be located at a position along the support column 20 that is configured to be approximately shoulder height to the average height user when the user is sitting on seat 16. Fixed pullies 32 and 34 can be adjustable relative to their position along support column 20.

Weight arm 26 extends from a first end at pivotal connection 30 to a second end 28 having posts 40 for supporting weight 42. Weights 42 are removable to allow a user to adjust the resistance by interchanging different amount of mass using weights 42. The more weights 42 attached to posts 40 the more resistance a user would feel against pull bar 22. Posts 40 can be posts configured for circular weights or the attachment of weights 42 can be accomplished by other means as should be known in the art.

Cable 24 interconnects pull bar 22 at one end and is passed through fixed pulleys 32 and 34 to connect to second end 28 of weight arm 26 on the other end of cable 24. Specifically, cable 24 connects with the weight arm 26 on the end on which weights 42 are positioned. Connection of cable 24 can be at any position from the middle of weight arm 26 to the terminus of second end 28.

When in use, the user will use pull bar 22 to move weight arm 26 between a pulled position and a released position. Power rowing machine 10 is shown in FIG. 1 in a released position. Power rowing machine 10 is shown in FIG. 2 in a pulled position. A user can sit on seat 16, put her/his feet on pedals 19 and hold pull bar 22. When the user pulls the pull bar 22, she/he pushes her/his feet against pedals 19, seat 16 slides on the seat beam 14 along the direction from leg 12 to the leg 11, with pull bar 22 pulling the cable 24 in the same direction as the seat 16 slides, thereby also pulling weight arm 26 up to pivot around pivotal connection 30. Seat 16 can move in conjunction with or independently from the movement of pull bar 22.

Figure 4:
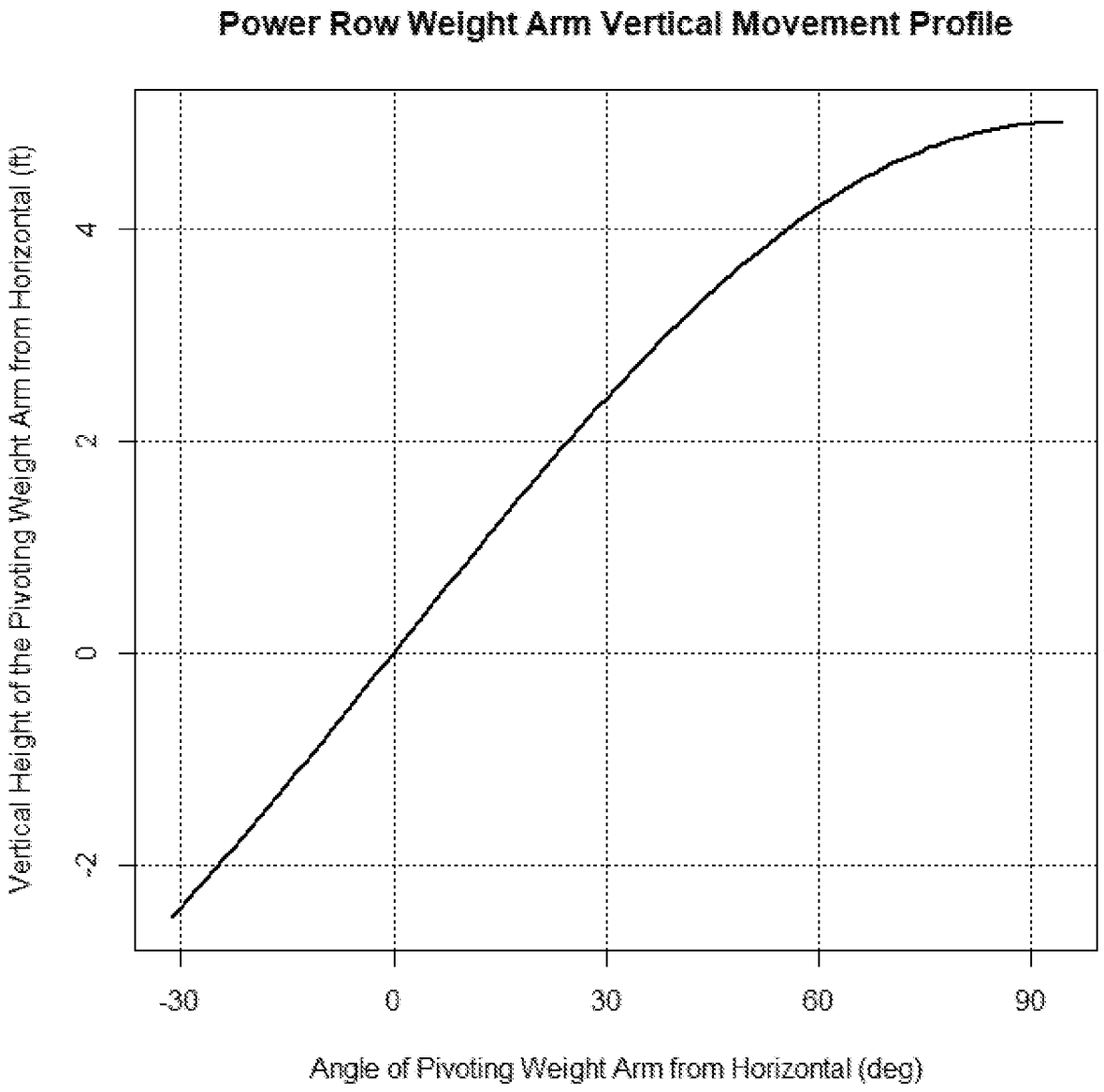
FIG. 4 is a graph of the vertical movement of the weight arm of a power rowing machine.
Figure 5:
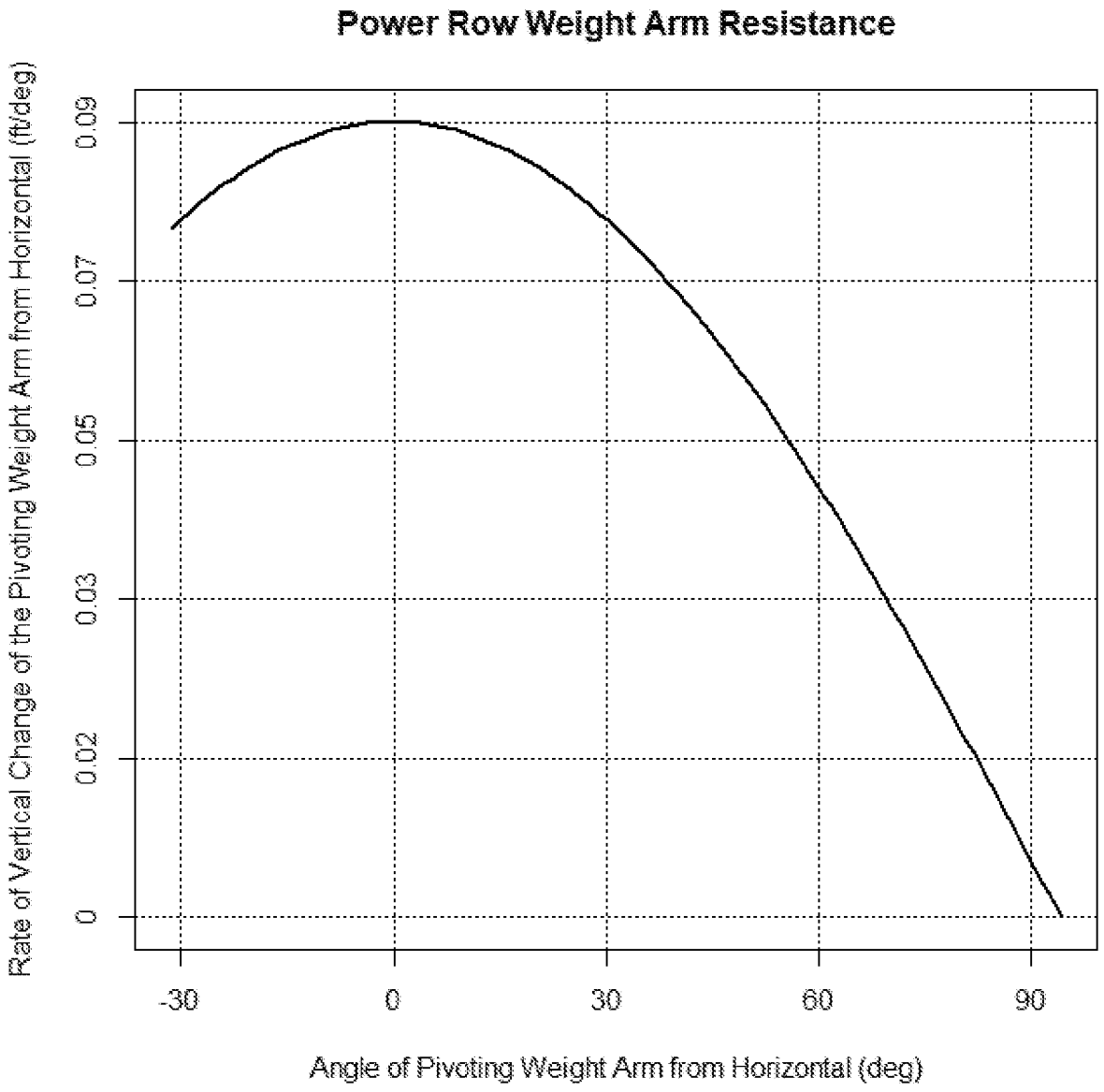
FIG. 5 is a graph of the resistance profile of a power rowing machine.

FIGS. 4 and 5 illustrate the physics of the movement of weight arm 26. As the handle is drawn there is a consistent change in the angle of weight arm 26. But, due to the vertical movement of the weight, i.e., the resistance at the end of the arm is not consistent as seen in FIG. 4. In FIG. 5, the resistance at any angle is represented. If weight arm 26 starts 30 degrees below horizontal and moves to 90 degrees (or vertical) then the resistance increases from the start and peaks when weight arm 26 is horizontal. The resistance then decreases to zero as weight arm 26 moves to vertical. The resistance profile can be adjusted by the start angle and the length of weight arm 26 (five feet in this example).

What is claimed is:

1. A rowing machine, comprising:

a seat beam extending along a longitudinal axis;

a support column having an upper end, an intermediate portion, and a lower end, wherein the support column is coupled to an end of the seat beam, and having a pair of fixed pulleys positioned above the longitudinal axis of the seat beam such that one of the pair of fixed pulleys is positioned at the intermediate portion of the support column and the other one of the pair of fixed pulleys is positioned at the upper end of the support column;

a weight arm pivotally coupled to the support column at a pivot end and extending to a free end having a pair of posts extending outwardly therefrom;

a cable having a first end connected to and extending from the free end of the weight arm and pair of fixed pulleys and to a second end that is positioned proximate to the seat beam, wherein the weight arm is pivotal between a horizontal position and a vertical position in response to a force applied to the cable such that when in the horizontal position the weight arm has an angle of less than zero degrees; and a pull bar coupled to the second end of the cable.

2. The rowing machine of claim 1, further comprising at least one leg configured to support the seat beam above the ground.

3. The rowing machine of claim 2, wherein the at least one leg is positioned at one end of the seat beam and another at least one leg is positioned at another end of the seat beam.

4. The rowing machine of claim 1, further comprising a support beam interconnecting the support column and the seat beam.

5. The rowing machine of claim 4, wherein the support beam includes at least one pedal extending outwardly therefrom.

6. The rowing machine of claim 5, wherein the at least one pedal is inclined toward the seat beam.

7. The rowing machine of claim 1, wherein the free end of the weight arm is positioned proximately to the one of the pair of fixed pulleys that is positioned at the upper end of the support column when the weight arm is in the vertical position.

8. The rowing machine of claim 1, further comprising at least one weight removably attached to at least one of the posts.

9. The rowing machine of claim 1, wherein the seat beam includes a seat configured to slide therealong.

10. The rowing machine of claim 9, wherein the seat beam includes a track extending therealong that is slidingly engaged with the seat.

11. The rowing machine of claim 9, wherein the seat includes rollers for travel along the track.

12. The rowing machine of claim 1, wherein when the weight arm is in the vertical position the weight arm has an angle of 90 degrees.

* * * * *